US006168353B1

(12) United States Patent
Price

(10) Patent No.: US 6,168,353 B1
(45) Date of Patent: Jan. 2, 2001

(54) RETAINING WALL AND METHOD OF WALL CONSTRUCTION

(75) Inventor: Raymond R. Price, Rochester, MN (US)

(73) Assignee: Rockwood Retaining Walls, Inc., Rochester, MN (US)

( * ) Notice: Under 35 U.S.C. 154(b), the term of this patent shall be extended for 0 days.

(21) Appl. No.: 09/141,670

(22) Filed: Aug. 27, 1998

(51) Int. Cl.[7] ..... E02D 29/02

(52) U.S. Cl. ..... 405/284; 405/286; 52/604; 52/439

(58) Field of Search ..... 405/284, 286; 52/604, 605, 606, 439

(56) References Cited

U.S. PATENT DOCUMENTS

| | | | | |
|---|---|---|---|---|
| D. 295,788 | | 5/1988 | Forsberg . | |
| D. 295,790 | | 5/1988 | Forsberg . | |
| D. 296,007 | | 5/1988 | Forsberg . | |
| D. 296,365 | | 6/1988 | Forsberg . | |
| D. 297,464 | | 8/1988 | Forsberg . | |
| D. 297,574 | | 9/1988 | Forsberg . | |
| D. 297,767 | | 9/1988 | Forsberg . | |
| D. 298,463 | | 11/1988 | Forsberg . | |
| D. 300,254 | | 3/1989 | Forsberg . | |
| 3,717,967 | * | 2/1973 | Wood | 52/439 |
| 3,995,434 | | 12/1976 | Kato et al. . | |
| 4,123,881 | | 11/1978 | Muse . | |
| 4,565,043 | | 1/1986 | Mazzarese . | |
| 4,802,320 | | 2/1989 | Forsberg . | |
| 4,825,619 | | 5/1989 | Forsberg . | |
| 4,964,761 | | 10/1990 | Rossi . | |
| 5,161,918 | | 11/1992 | Hodel . | |
| 5,337,527 | | 8/1994 | Wagenaar . | |
| 5,353,569 | | 10/1994 | Rodrique . | |
| 5,425,600 | | 6/1995 | Gordon . | |
| 5,490,363 | | 2/1996 | Woolford . | |
| 5,653,558 | | 8/1997 | Price . | |
| 5,951,210 | * | 9/1999 | Maguire et al. | 405/286 |
| 6,060,772 | * | 5/2000 | Perkins | 405/284 |

* cited by examiner

*Primary Examiner*—Eileen D. Lillis
*Assistant Examiner*—Sunil Singh
(74) *Attorney, Agent, or Firm*—Moore & Hansen

(57) ABSTRACT

A retaining wall made up of a plurality of blocks shaped to prevent the escape of material used to fill the cavities of the wall while allowing dissipation of pressures exerted on the wall by the retained earth and a method of constructing the wall taking advantage of the continuous, uninterrupted vertical cavities formed by the unique shape of the blocks. The shape of the blocks comprises a front portion interconnected to a rear portion which has ears on opposite sides which cooperate on adjacent blocks to create a tortuous path into a space created between two adjacent blocks. In a preferred embodiment the rear portion further comprises a cavity which, when pyramidally placed on top of two adjacent blocks, forms a continuous, uninterrupted vertical column which significantly increases the weight and strength of the wall when filled with a particulate filling material.

25 Claims, 3 Drawing Sheets

RETAINING WALL AND METHOD OF WALL CONSTRUCTION

BACKGROUND OF THE INVENTION

This invention relates generally to the construction of retaining walls used in landscaping applications. Such walls are used to provide lateral support between differing ground levels where the change in one elevation to the other occurs over a relatively short distance. More particularly, the instant invention relates to a retaining wall block and a method of wall construction from blocks so shaped that they form uninterrupted continuous vertical columns which can be filled with a particulate matter, strengthening the wall. When filled, the columns become two horizontally spaced, separately functioning columnar walls of rock. Furthermore, the laws of entropy dictate that with time and weather, these columns of rock will settle, becoming more dense and solidified, effectively forming two rock walls within the wall which becomes stronger over time. The blocks have segments or ears on the rear portion which cooperate with each other on adjacent blocks so as to form a substantially closed rear wall. This structure insures that the rock particles in the plurality of vertical columns are contained therein and cannot move outwardly. The inner columnar rock walls then alleviate the need for reenforcing members such as rods or bars. The blocks are also shaped to allow water to flow through the wall, preventing the buildup of hydrostatic pressure behind the wall.

Retaining walls are widely used in landscaping and allow abrupt changes in elevation while reducing the possibility of erosion and land slides. They can be both functional and decorative and range from small gardening applications to large-scale construction. Retaining walls are constructed of a variety of materials and shapes. Some have been constructed of wood timbers, others of rock in a natural form (such as limestone). Still others have been constructed of manufactured aggregate or concrete blocks. The present invention relates to a manufactured block.

The most important consideration when designing a retaining wall is strength. The wall must be able to support the weight of the earth it retains for many years without collapsing or becoming distorted. To achieve this, a variety of block shapes have been developed. U.S. Pat. Nos. 4,802,320 and 4,825,619 issued to Forsberg, U.S. Pat. No. 5,161,918 issued to Hodel, U.S. Pat. No. 5,337,527 issued to Wagenaar, U.S. Pat. No. 5,490,363 issued to Woolford, and U.S. Pat. No. 5,653,558 issued to this inventor all show blocks that incorporate rearward projections which anchor the blocks into the retained earth. During construction of these walls, the cavities contained within, or formed between, these projections are filled with particulate matter upon completion of each course of blocks to add weight and stability to the resulting wall. Maximizing the size and height of the cavities increases the amount of fill that can be used, thereby maximizing the weight and strength of the completely filled wall, and also reduces the weight and shipping costs of the individual blocks.

A problem the prior art has failed to overcome is producing a shape that both maximizes the volume of the cavities and allows curves to be built into the wall without having to painstakingly chisel away at the back portions of the blocks or utilize a variety of differently shaped or sized blocks. Blocks made for use with curved walls typically have narrow rear portions that would not interfere with each other but would not provide optimal stability. These blocks often require the complicated use of pins or rods to add stability.

BRIEF SUMMARY OF THE INVENTION

It is a primary object of this invention to provide a retaining wall block and a wall constructed of a plurality of blocks shaped to form continuous, uninterrupted, substantially vertical cavity columns.

It is another object to provide a retaining wall that increases the effectiveness of an anchoring mesh.

It is a further object to provide a retaining wall block that can be used in any area of the wall, including straight portions, curves or corners.

It is another object to provide a retaining wall that retains fill material while allowing pressure and moisture from the retained earth to be dissipated throughout the wall.

It is also an object to provide a method of constructing a retaining wall such that vertical, columnar, rock walls are formed within the retaining wall while providing a means for preventing the particulate rock used in the columnar walls from escaping rearwardly from the columns.

It is a further object to provide a retaining wall block that is "self-locking" between various courses of the wall.

It is still another object to provide a retaining wall that is very resistant to shear forces along horizontal lines.

It is also an object to provide a retaining wall block that is "self-spacing" with respect to the blocks of the next lower course upon which the block is placed and supported, thereby ensuring a properly angled, uniform back-slope along the wall, wherein the angle of the back-slope may be varied according to the circumstances in which the wall is constructed.

The instant invention comprises a block and a wall constructed of a plurality of such blocks shaped to form uninterrupted, vertical columns. The block structure permits it to be used to construct curved or straight walls without requiring reshaping.

The shape of the block comprises a front portion connected to a rear portion. A pair of laterally projecting ears are formed on opposed side walls of the rear portion. When two blocks are placed next to each other such that the front portions abut, a cavity is formed between the two blocks which is defined in the rear by two adjacent ears. These ears form a tortuous path into the cavity which retains the fill material while allowing pressures exerted by the retained earth to dissipate within the wall. In a preferred embodiment, one of these ears is offset toward the front portion. Such a block construction not only assists in forming the tortuous path, but it also permits ears on adjacent blocks to overlap, thereby facilitating the construction of curved walls.

The rear portion of each block preferably has two side wall members and a rear wall member which define an inner cavity that, when a block is placed in overlapping relation on top of two adjacent blocks, aligns with the space between the two blocks below it to form a substantially vertical, uninterrupted column. When these columns are filled with particulate matter, preferably crushed rock, it will be seen that the weight and stability of the wall increases dramatically. Furthermore, if an anchoring mesh or netting is used, the weight of the particulate matter filling these vertical columns will stretch the grid of the mesh, significantly increasing the anchoring ability of the mesh. Because the back of the wall is substantially closed by the projecting ears, the crushed rock cannot escape rearwardly from the columns. Over time, forces exerted on the crushed rock can only result in the crushed rock becoming more compacted, making the columns stronger. The wall then becomes very resistant to shear forces along horizontal lines.

The rear member of the rear portion of each block may also contain a downwardly projecting abutment member which overlaps the rear face of the block below to ensure that a uniform back-slope is achieved in the wall when the blocks are vertically stacked.

The front portion and rear portion of the block may be connected by a neck which may have a downwardly projecting abutment member which acts as a spacer and an anchor when placed in the space created between two lower blocks. The neck also defines additional spaces which form cavities when placed next to adjacent blocks. The face of the front portion is decorative and can be flat, curved or multi-faceted.

DESCRIPTION OF THE PREFERRED EMBODIMENTS

Figure 1:
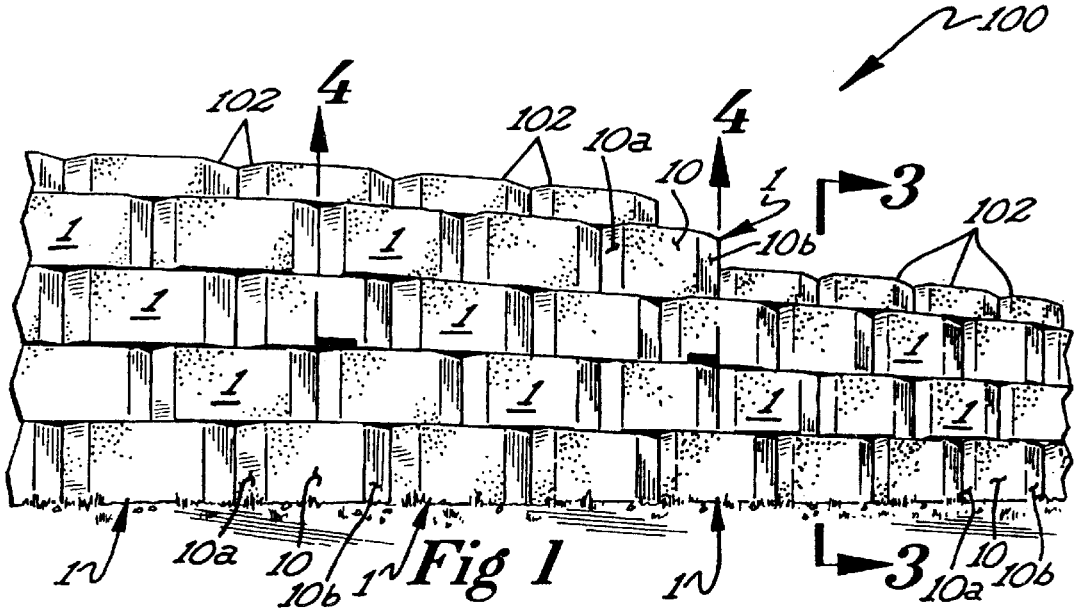
FIG. 1 is a front, perspective, partial view of a completed retaining wall of the present invention.

With reference to the drawings, and first to FIG. 1, there is shown a retaining wall 100 consisting of a number of courses of blocks 1 extending from just below the surface of a lower level to just above the surface of an upper level (not shown). The top of the last course of blocks 1 in any given portion of the wall 100 may be capped with a plurality of caps 102 which do not form a basis or a part of the present invention.

Each course of blocks 1 comprises a plurality of blocks 1 arranged side to side in the conventional fashion to present a substantially continuous forward facing surface extending generally horizontally. Except for the lower course, which is laid upon a prepared base slightly beneath the surface of the lower level, each course is laid upon the preceding course in the manner hereafter described, with each block 1 in the higher course being staggered with respect to the blocks 1 upon which it rests in the lower course in the manner shown in FIGS. 2 and 4.

Figure 2:
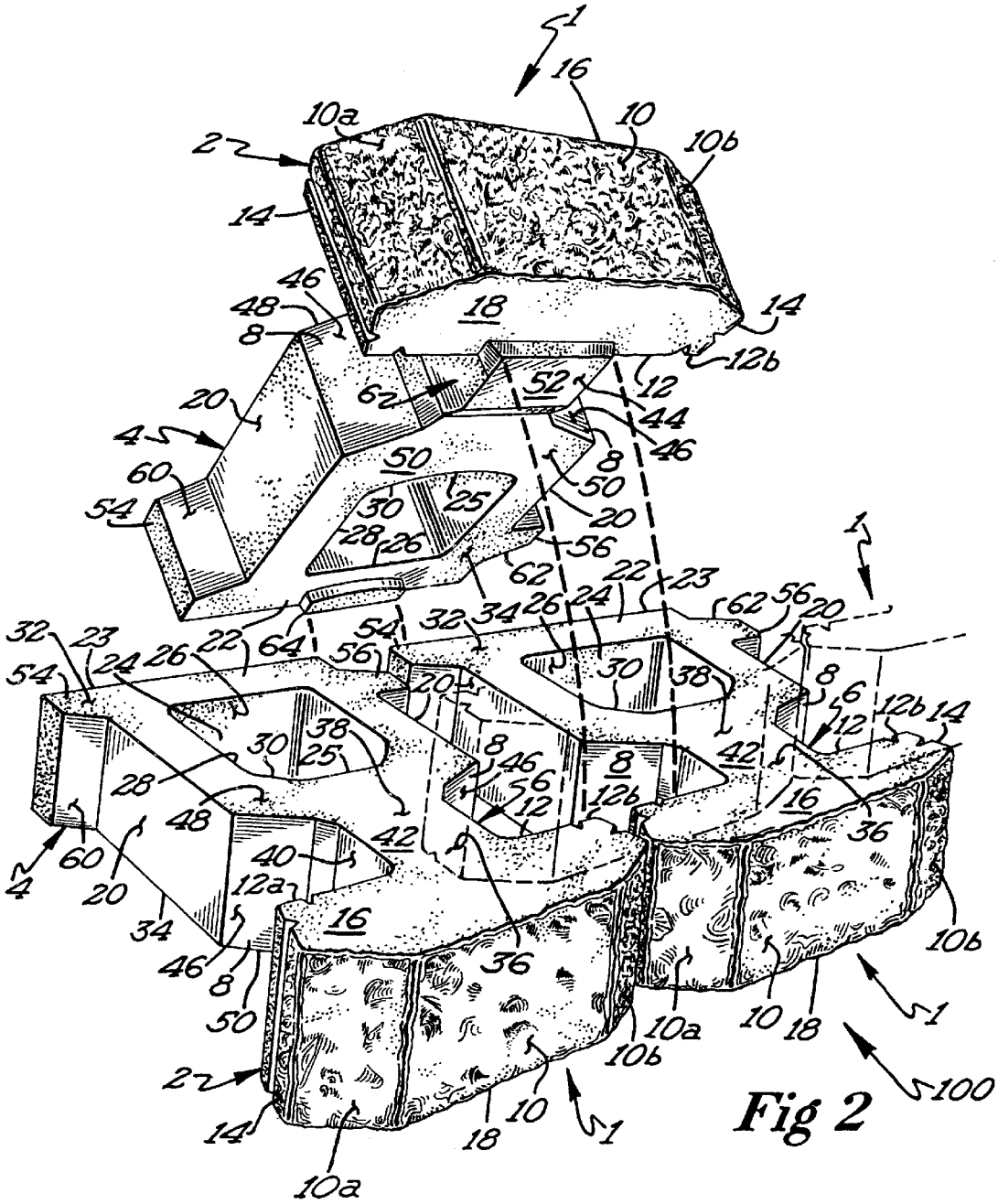
FIG. 2 is a front, elevational perspective view showing how a block of the present invention fits on top of a lower course of the similar blocks.
Figure 4:
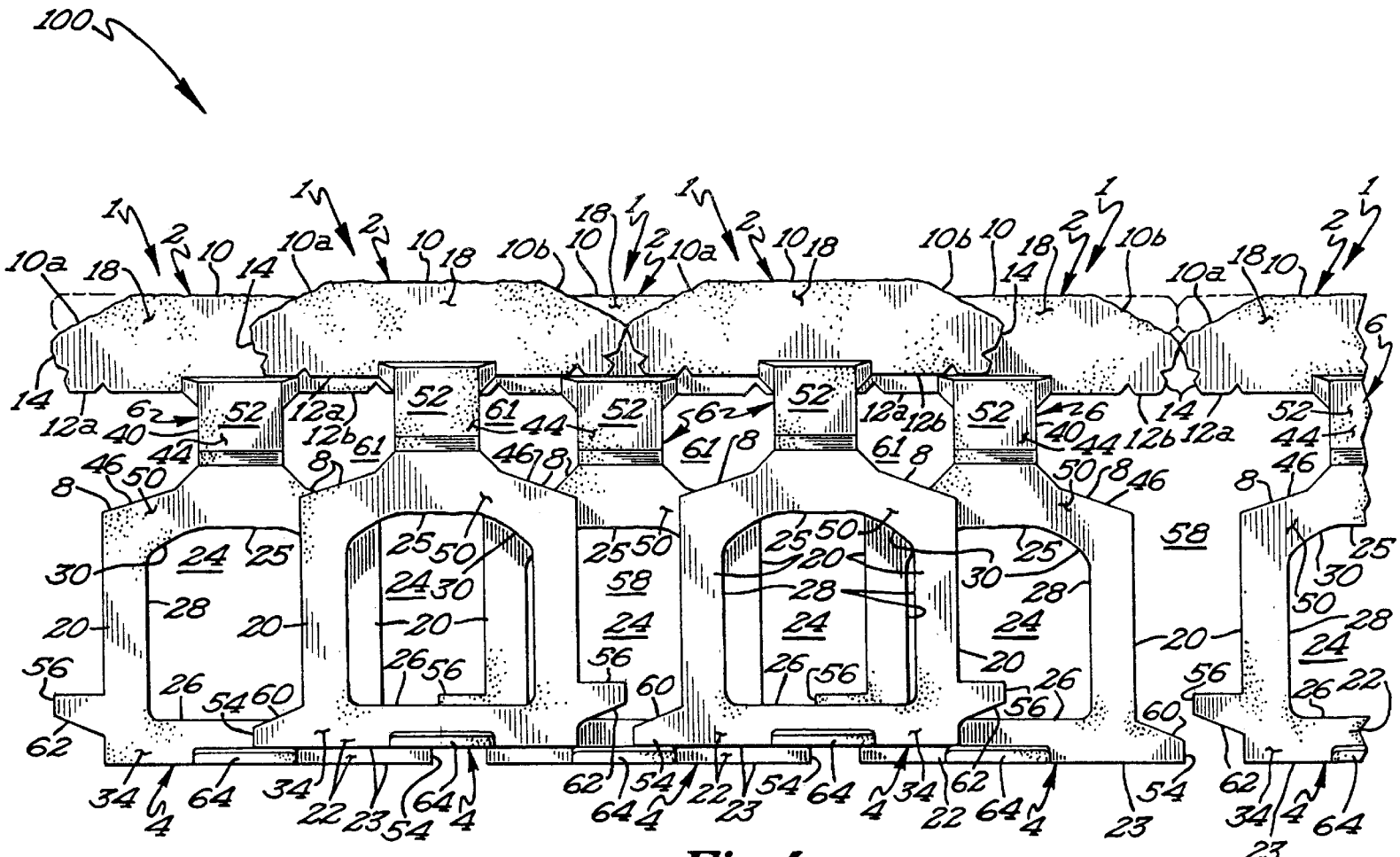
FIG. 4 is a bottom sectional view of a portion of the wall of the present invention taken generally along the line 4—4 of FIG. 1, looking upwardly, and showing the vertical cavity columns formed by the blocks of two courses vertically stacked.

FIGS. 2 and 4 illustrate the structure of each block 1. The blocks 1 are advantageously formed of a poured aggregate material such as concrete to define a unitary piece. Each block 1 comprises a front portion 2 connected to a rear portion 4. In a preferred embodiment, the front portion 2 is connected to the rear portion 4 via a neck 6 and shoulders 8

The front portion 2 comprises an outer or front face 10, back faces 12*a* and 12*b*, two side faces 14, a top surface 16 and a bottom surface 18. For appearance 20 purposes, the front face may be cut or formed to provide beveled side walls 10*a* and 10*b*. The rear portion 4 has two opposing side wall members 20 and a rear wall member 22. Each wall member of the rear portion 4 has a top surface 32 and a bottom surface 34 which are flush with each other and the top surface 16 and the bottom surface 18 of the front portion 2 respectively.

The rear wall member 22 has an outer or rear surface 23. The rear portion 4 is preferably narrower than the front portion 2.

In a preferred embodiment, the side members 20 are connected to the rear member 22 and the front portion 2 such that an inner cavity 24 is formed and defined by the inner surface 26 of the rear member 22, the inner surfaces 28 of the side members 20 and the inner face surface 25. The side members 20 are preferably substantially perpendicular to the front portion 2 and rear member 22.

In the preferred embodiment, the front portion 2 is connected to the rear portion 4 via a neck 6 and shoulders 8. The neck 6 comprises a front end 36 connected to the back faces 12*a* and 12*b* of the front portion 2, a shoulder end 38 connected to the shoulders 8, two side surfaces 40, a top surface 42 and a bottom surface 44. The shoulders 8 comprise an outer surface 46 on either side of the neck 6, an inner surface 30, a top surface 48, and a bottom surface 50. The shoulders 8 are connected to the side members 20 such that the inner cavity 24 is formed and defined by the inner surface 26 of the rear member 22, the inner surfaces 28 of the side members 20 and the inner surface 30 of the shoulders 8.

Figure 3:
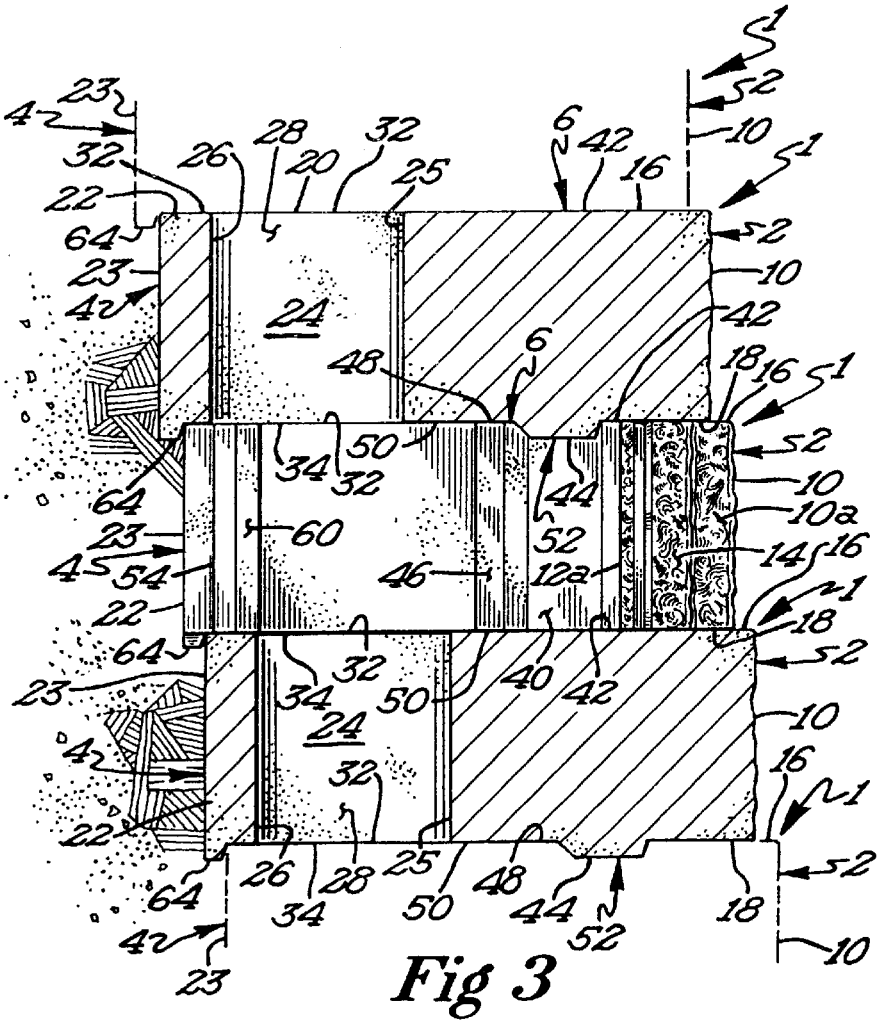
FIG. 3 is a side sectional view of a portion of the wall of the present invention taken generally along the line 3—3 of FIG. 1.

All of the top surfaces 16, 32, 42, and 48 are flush with each other. Similarly, all of the bottom surfaces 18, 34, 44, and 50 are flush with each other in this embodiment. In a preferred embodiment, however, the bottom surface 44 of the neck 6 is lowered, creating an abutment member 52 which serves to anchor the block 1 into the lower course of blocks 1 as seen in FIGS. 2, 3 and 4.

The blocks have segments on the rear portion 4 which cooperate with each other on adjacent blocks so as to form a substantially closed rear wall. This structure insures that the rock particles in the plurality of vertical columns are contained therein and cannot move outwardly. A preferred way of accomplishing this advantageous result is by the use of laterally projecting ears 54 and 56. A defining ear 54 protrudes generally laterally outwardly from a side member 20 proximate the rear member 22 toward the side member 20 of an adjacent block 1. The defining ear 54 defines the opening to an inter cavity 58 formed between two adjacent blocks 1. The opening to the inter cavity 58 is further defined by a deflecting ear 56 which protrudes generally laterally outwardly from the other side member 20 proximate the rear member 22 toward the side member 20 of a block 1 adjacent that side member 20. The defining ear 54 and the deflecting ear 56 act together to create a tortuous path into the inter cavity 58.

In a preferred embodiment, the deflecting ear 56 is offset toward the front portion 2 such that the deflecting ear 56 on one block and the defining ear 54 of an adjacent block 1 overlap as shown in FIG. 4. In another embodiment, the defining ear 54 comprises a forward face 60 and the deflecting ear 56 comprises a rearward face 62 which opposes the forward face 60 of the defining ear 54 of an adjacent block 1. Preferably, the forward face 60 of the defining ear 54 is substantially parallel to the rearward face 62 of the adjacent deflecting ear 56.

By the disclosed block configuration, two separate rows of vertical support columns of rock are formed. One such column is along the rear side of the wall and is comprised of the horizontal row of vertical columns 24. The second row extends along the front side of the wall and is comprised of the horizontal rows of vertical columns 61.

To construct a retaining wall 100, a first course of blocks 1 is laid in a prepared, leveled area slightly below the lower level. In each course, including the first, the blocks 1 are laid in such a fashion that the ends of the front portions 2 of each block 1 abut one side 14 of the front portions 2 of the next adjacent block 1. When a course has been laid, particulate fill material is backfilled behind the blocks 1 and into the inter cavities 58 and inner cavities 24 of the blocks 1. Thus, it will be seen that the accumulation of fill material stabilizes the wall 100 and the rear portions 4 act to anchor the wall 100.

The next course is laid upon the previous course in staggered fashion as best seen in FIGS. 2 and 4. The center of each block 1 is placed over the abutting ends of two blocks 1 in the lower course. This not only adds to the wall 100 aesthetically, but also stabilizes the wall 100 against lateral movement. When placing a block 1, the abutment member 52 is placed in abutment against the outer ends of the back faces 12*a* and 12*b* of the two blocks 1 immediately below the block 1 being placed. The blocks 1 may also have a spacing protrusion 64 extending downwardly from the bottom surface 34 of the rear member 22 which serves to give the constructed wall 100 a uniform backslope as best seen in FIG. 3. This spacing protrusion 64 is placed in abutment against the outer surface 23 of the rear members 22 of the two blocks 1 immediately below the block 1 being placed.

The side faces 14 of the blocks 1 are tapered rearwardly as seen in FIG. 2. This facilitates the orientation of successive blocks 1 at oblique angles to one another as in the case of a convex curve in the wall 100. Similarly, to facilitate the orientation of successive blocks 1 at oblique angles to one another as in the case of a convex curve in the wall 100, the rear portions 4 are narrower than the front portions 2 and the ears 54, 56 overlap each other so as to prevent interference between the two adjacent blocks 1.

It is envisioned that an anchoring mesh can be used between a predetermined number of courses of blocks 1. Anchoring mesh is known in the art and significantly improves the stability of a wall. When placed between courses of blocks 1, the fill material which is placed in the inner cavities 24 and inter cavities 58 stretches the anchoring mesh due to the weight of the continuous, uninterrupted, substantially vertical column of fill material formed by the aligning inner cavities 24 and inter cavities 58 of the courses of blocks I above the anchoring mesh.

The present invention having thus been described, other modifications, alterations or substitutions may present themselves to those skilled in the art, all of which are within the spirit and scope of the present invention. It is therefore intended that the present invention be limited in scope only by the claims attached below:

What is claimed is:

1. A block for constructing a retaining wall comprising:

(a) a front portion having a front face, a back face, a top surface, and a bottom surface;

(b) a rear portion having two opposed side members and a rear member, each of said members having an outer surface, an inner surface, a top surface and a bottom surface, said side members interconnected with the front portion and the rear member;

(c) a defining ear extending generally laterally outwardly from one of the side members proximate the rear member;

(d) a deflecting ear extending generally laterally outwardly from the other side member proximate the rear member, such that when two of the blocks are placed side by side to form a wall having a front face with a convex curve, the defining ear of one block and the deflecting ear of the other block overlap to form a tortuous path of predetermined size into an inter cavity between the two blocks defined by the adjacent front portion back faces of the two blocks, and the opposing outer surfaces of the side members of the two blocks.

2. The block according to claim 1 wherein the front portion is horizontally wider than the rear member.

3. The block according to claim 1 wherein the side members are substantially perpendicular to the front portion.

4. The block according to claim 1 wherein the defining ear has a forward face and the deflecting ear has a rearward face.

5. The block according to claim 4 wherein the defining ear is closer to the outer surface of the rear member than the deflecting ear.

6. The block according to claim 5 wherein the forward face of the defining ear and the rearward face of the deflecting ear are substantially parallel.

7. The block according to claim 1 wherein the side members are connected to the front portion and the rear member in a manner such that an inner cavity is formed, said inner cavity being defined by an inner face surface, the inner surfaces of each of the side members, and the inner surface of the rear member.

8. The block of claim 1 wherein the rear portion is connected to the front portion via a neck with a front end, a shoulder end and two side surfaces, and two shoulders with inner surfaces and outer surfaces whereby the back face of the front portion is connected to the front end of the neck which branches into the two shoulders at the shoulder end of the neck, said shoulders being connected to the side members of the rear portion.

9. A retaining wall structure comprised of a plurality of blocks wherein a horizontally staggered vertical arrangement of courses of horizontally adjacent blocks forms a plurality of substantially uninterrupted, substantially closed vertical cavity columns, each of the blocks comprising;

(a) a front portion having a front face, a back face, a top surface, and a bottom surface;

(b) a rear portion having two opposing side members and a rear member, each of said members having an outer surface, a top surface and a bottom surface;

(c) a neck and shoulders, said neck comprising a front end, a shoulder end, two side surfaces, a top surface and a bottom surface, each of said shoulders comprising an outer surface, an inner surface, a top surface and a bottom surface, said neck and shoulders connecting the front and rear portions such that the back face of the front portion is connected to the front end of the neck which then branches into the shoulders at the shoulder end of the neck, said shoulders are then connected to the forward most areas of the side members of the rear portion, each of said side members further comprising an inner surface, said side members being connected to the rear member and the shoulders such that an inner cavity is formed, said inner cavity being defined by the inner surfaces of the opposing side members, an inner surface of the rear member, and the inner surfaces of the shoulders.

10. The retaining wall of claim 9, wherein the blocks further comprise:

(a) a defining ear extending outwardly from one of the side members proximate the rear member;

(b) a deflecting ear extending outwardly from the side member opposite the side member containing the defining ear, proximate the rear member, such that when two of the blocks are placed side by side, the defining ear of one block and the deflecting ear of the other block form a tortuous path into a cavity between the two blocks defined by the back faces of the two blocks, and the opposing outer surfaces of side members of the two blocks.

11. The retaining wall of claim 10 wherein said defining ear is closer to the rear member of the block than said deflecting ear.

12. The retaining wall of claim 11 wherein the defining ear further comprises a forward face and the deflecting ear further comprises a rearward face which opposes the forward face of the defining ear of the adjacent block.

13. The retaining wall of claim 12 wherein the forward face of the defining ear is substantially parallel to the opposing rearward face of the deflecting ear of the adjacent block.

14. The retaining wall of claim 9 wherein the blocks further comprise a defining ear and a deflecting ear with the defining ear being closer to the rear member of the block than the deflecting ear, whereby the two ears on each block are offset in a direction between the front and rear portions of each block.

15. The retaining wall of claim 14 wherein the defining ear further comprises a forward face and the deflecting ear further comprises a rearward face which opposes the forward face of the defining ear of the adjacent block.

16. The retaining wall of claim 15 wherein the forward face of the defining ear is substantially parallel to the opposing rearward face of the deflecting ear of the adjacent block.

17. The retaining wall of claim 14 wherein the defining ear further comprises a forward face and the deflecting ear further comprises a rearward face which opposes the forward face of the defining ear of the adjacent block in spaced apart relation thereto.

18. The retaining wall of claim 17 wherein the forward face of the defining ear is substantially parallel to the opposing rearward face of the deflecting ear of the adjacent block.

19. The retaining wall of claim 9 wherein the plurality of substantially uninterrupted, substantially closed vertical cavity columns are filled with rock particles such that two rows of staggered, substantially vertical support columns of rock are formed within the retaining wall.

20. The retaining wall of claim 19 wherein the retaining wall further comprises a means for forming a substantially closed, substantially continuous rear face which retains substantially all of the fill particles within the cavities of the wall by preventing said fill particles from escaping rearwardly from the columns.

21. A method of constructing a retaining wall from a plurality of blocks, each of said blocks having a front portion with a front face, a back face, a top surface, and a bottom surface; a rear portion having two side members and a rear member, each of said members having an outer surface, an inner surface, a top surface and a bottom surface, said side members interconnected with the front portion and the rear member in a manner such that an inner cavity is formed, said inner cavity being defined by an inner face surface, the inner surfaces of each of the side members, and the inner surface of the rear member; said side members spaced such that an inter cavity is formed between the side members of adjacent blocks so that when a block is placed pyramidally on top of two adjacent blocks the inner cavity of the top block and the inter cavity of the two lower blocks align to form a substantially uninterrupted vert cal column; and wherein the blocks further comprise a defining ear and a deflecting ear with the defining ear being closer to the rear member of the block than the deflecting ear; comprising the steps of:

(a) forming a bottom course of blocks by placing a plurality of blocks side by side so that the outer face surfaces of the blocks align to form a desired front shape of the resulting retaining wall and whereby the defining ear and deflecting ear on adjacent blocks in the bottom course of blocks are offset in a direction between the front and rear portions of the respective adjacent blocks;

(b) forming a second course of blocks on top of the first course by placing a plurality of blocks side by side such that the blocks of the second course are staggered from the blocks of the bottom course and the inner cavities of the blocks of the second course substantially align with the inter cavities of the blocks of the bottom course to form substantially uninterrupted vertical columns, and whereby the defining ear and deflecting ear on adjacent blocks in the second course of blocks are offset in a direction between the front and rear portions of the respective adjacent blocks;

(c) filling the substantially uninterrupted vertical columns with a fill substance comprised of particulate matter; and, (d) forming vertically subsequent horizontal courses in a similar manner until the retaining wall reaches a desired height.

22. The method of claim 21 wherein the fill substance used comprises rock particles which are totally contained within the vertical columns.

23. A block for constructing a retaining wall comprising:

(a) a front portion having a front face, a back face, a top surface, and a bottom surface;

(b) a rear portion having two opposed side members and a rear member, each of said members having an outer surface, an inner surface, a top surface and a bottom surface, said side members interconnected with the front portion and the rear member;

(c) a defining ear, having a forward face, and extending generally laterally outwardly from one of the side members proximate the rear member;

(d) a deflecting ear, having a rearward face, and extending generally laterally outwardly from the other side member proximate the rear member, such that when two of the blocks are placed side by side, the defining ear of one block and the deflecting ear of the other block form a tortuous path of predetermined size into an inter cavity between the two blocks defined by the adjacent front portion back faces of the two blocks, and the opposing outer surfaces of the side members of the two blocks, and wherein said defining ear is closer to the outer surface of the rear member than said deflecting ear.

24. The block according to claim 23 wherein the forward face of the defining ear and the rearward face of the deflecting ear are substantially parallel.

25. A block for constructing a retaining wall comprising:

(a) a front portion having a front face, a back face, a top surface, and a bottom surface;

(b) a rear portion having two opposed side members and a rear member, each of said members having an outer surface, an inner surface, a top surface and a bottom surface, said side members interconnected with the front portion and the rear member;

(c) a neck joining the rear portion and the front portion, the neck comprising a front end, a shoulder end, two side surfaces, and two shoulders with inner surfaces and outer surfaces whereby the back face of the front portion is connected to the front end of the neck which branches into the two shoulders at the shoulder end of the neck, said shoulders being connected to the side members of the rear portion;

(d) a defining ear extending generally laterally outwardly from one of the side members proximate the rear member;

(e) a deflecting ear extending generally laterally outwardly from the other side member proximate the rear member, such that when two of the blocks are placed side by side, the defining ear of one block and the deflecting ear of the other block form a tortuous path of predetermined size into an inter cavity between the two blocks defined by the adjacent front portion back faces of the two blocks, and the opposing outer surfaces of the side members of the two blocks.

* * * * *